US008689865B2

(12) United States Patent
Banerjee et al.

(10) Patent No.: US 8,689,865 B2
(45) Date of Patent: Apr. 8, 2014

(54) PROCESS FOR ENHANCED PRODUCTION OF HEAVY OIL USING MICROWAVES

(75) Inventors: Dwijen K. Banerjee, Owasso, OK (US); John L. Stalder, Calgary (CA); Daniel R. Sultenfuss, Houston, TX (US); Wendell P. Menard, Katy, TX (US); Wayne R. Dreher, Jr., College Station, TX (US); Curtis G. Blount, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 203 days.

(21) Appl. No.: 13/154,882

(22) Filed: Jun. 7, 2011

(65) Prior Publication Data

US 2011/0259585 A1 Oct. 27, 2011

Related U.S. Application Data

(63) Continuation-in-part of application No. 12/239,051, filed on Sep. 26, 2008, now Pat. No. 7,975,763.

(60) Provisional application No. 61/382,763, filed on Sep. 14, 2010, provisional application No. 61/414,744, filed on Nov. 17, 2010.

(51) Int. Cl.

| | |
|---|---|
| ***E21B 43/24*** | (2006.01) |
| ***E21B 43/26*** | (2006.01) |
| ***E21B 43/267*** | (2006.01) |

(52) U.S. Cl.

USPC .... 166/248; 166/65.1; 166/272.1; 166/272.3; 166/272.6; 166/272.7; 166/280.1; 166/302; 166/308.1

(58) Field of Classification Search

None

See application file for complete search history.

(56) References Cited

U.S. PATENT DOCUMENTS

| | | | | |
|---|---|---|---|---|
| 3,237,690 | A * | 3/1966 | Karp et al. | 166/281 |
| 4,094,798 | A | 6/1978 | Tate et al. | |
| RE30,738 | E | 9/1981 | Bridges et al. | |
| 4,457,365 | A | 7/1984 | Kasevich et al. | |
| 4,485,868 | A | 12/1984 | Sresty et al. | |
| 4,620,593 | A | 11/1986 | Haagensen | |
| 4,638,863 | A | 1/1987 | Wilson | |
| 4,700,716 | A | 10/1987 | Kasevich et al. | |
| 4,817,711 | A | 4/1989 | Jeambey | |
| 4,912,971 | A | 4/1990 | Jeambey | |
| 5,082,054 | A | 1/1992 | Kiamanesh | |
| 5,109,927 | A | 5/1992 | Supernaw et al. | |
| 5,321,222 | A | 6/1994 | Bible et al. | |
| 5,521,360 | A | 5/1996 | Johnson et al. | |

(Continued)

FOREIGN PATENT DOCUMENTS

| | | |
|---|---|---|
| GB | 0896407 | 5/1962 |
| JP | 5112004104 | 10/1976 |
| WO | 2007/081493 A2 | 7/2007 |

OTHER PUBLICATIONS

Deutsch, C.V. and McLennan, J.A., Guide to SAGD (Steam Assisted Gravity Drainage) Reservoir Characterization Using Geostatistics, 2005, Centre for Computational Geostatistics.

*Primary Examiner* — George Suchfield

(74) *Attorney, Agent, or Firm* — ConocoPhillips Company

(57) ABSTRACT

A process for utilizing microwaves to heat $H_2O$ within a subterranean region wherein the heated $H_2O$ contacts heavy oil in the subterranean region to lower the viscosity of the heavy oil and improve production of the heavy oil.

21 Claims, 3 Drawing Sheets

(56) References Cited

U.S. PATENT DOCUMENTS

| | | | | |
|---|---|---|---|---|
| 5,899,274 | A | 5/1999 | Frauenfeld et al. | |
| 6,012,520 | A | 1/2000 | Yu et al. | |
| 6,544,411 | B2 | 4/2003 | Varadaraj | |
| 6,814,141 | B2 | 11/2004 | Huh et al. | |
| 6,929,066 | B2 * | 8/2005 | Hill | 166/250.1 |
| 7,073,577 | B2 | 7/2006 | Yu | |
| 7,091,460 | B2 | 8/2006 | Kinzer | |
| 7,461,693 | B2 | 12/2008 | Considine et al. | |
| 7,484,561 | B2 | 2/2009 | Bridges | |
| 7,677,673 | B2 | 3/2010 | Tranquilla et al. | |
| 7,975,763 | B2 * | 7/2011 | Banerjee et al. | 166/248 |
| 2004/0040717 | A1 * | 3/2004 | Hill | 166/308.1 |
| 2005/0199386 | A1 | 9/2005 | Kinzer | |
| 2007/0131591 | A1 | 6/2007 | Pringle | |
| 2007/0289736 | A1 * | 12/2007 | Kearl et al. | 166/248 |
| 2008/0073079 | A1 | 3/2008 | Tranquilla et al. | |
| 2009/0071648 | A1 | 3/2009 | Hagen et al. | |
| 2009/0139716 | A1 | 6/2009 | Brock et al. | |
| 2011/0186295 | A1 * | 8/2011 | Kaminsky et al. | 166/302 |
| 2012/0061081 | A1 * | 3/2012 | Sultenfuss et al. | 166/303 |

* cited by examiner

PROCESS FOR ENHANCED PRODUCTION OF HEAVY OIL USING MICROWAVES

CROSS-REFERENCE TO RELATED APPLICATIONS

This application is a continuation-in-part application which claims benefit under 35 USC §120 to U.S. application Ser. No. 12/239,051 filed Sep. 26, 2008 entitled "PROCESS FOR ENHANCED PRODUCING OF HEAVY OIL USING MICROWAVES," incorporated herein in their entirety and a non-provisional application which claims benefit under 35 USC §119(e) to U.S. Provisional Application Ser. No. 61/382,763 filed Sep. 14, 2010 entitled "FRACTURING SHALE AND MUDSTONE LAYERS TO IMPROVE SAGD PERFORMANCE" and U.S. Provisional Application Ser. No. 61/414,744 filed Nov. 17, 2010 entitled "FRACTURING SHALE AND MUDSTONE LAYERS TO IMPROVE SAGD PERFORMANCE" which is incorporated herein in its entirety.

STATEMENT REGARDING FEDERALLY SPONSORED RESEARCH OR DEVELOPMENT

None.

FIELD OF THE INVENTION

The present invention relates generally to a process for recovering heavy oil from a reservoir. In particular, the invention provides for utilizing microwaves to heat $H_2O$ which interacts with the heavy oil in the reservoir to lower the viscosity of the heavy oil.

BACKGROUND OF THE INVENTION

Heavy oil is naturally formed oil with very high viscosity but often contains impurities such as sulfur. While conventional light oil has viscosities ranging from about 0.5 centipoise (cP) to about 100 cP, heavy oil has a viscosity that ranges from 100 cP to over 1,000,000 cP. Heavy oil reserves are estimated to equal about fifteen percent of the total remaining oil resources in the world. In the United States alone, heavy oil resources are estimated at about 30.5 billion barrels and heavy oil production accounts for a substantial portion of domestic oil production. For example, in California alone, heavy oil production accounts for over sixty percent of the states total oil production. With reserves of conventional light oil becoming more difficult to find, improved methods of heavy oil extractions have become more important. Unfortunately, heavy oil is typically expensive to extract and recovery is much slower and less complete than for lighter oil reserves. Therefore, there is a compelling need to develop a more efficient and effective means for extracting heavy oil.

Viscous oil that is too deep to be mined from the surface may be heated with hot fluids or steam to reduce the viscosity sufficiently for recovery by production wells. One thermal method, known as steam assisted gravity drainage (SAGD), provides for steam injection and oil production to be carried out through separate wellbores. The optimal configuration is an injector well which is substantially parallel to and situated above a producer well, which lies horizontally near the bottom of the formation. Thermal communication between the two wells is established and, as oil is mobilized and produced, a steam chamber or chest develops. Oil at the surface of the enlarging chest is constantly mobilized by contact with steam and drains under the influence of gravity.

One factor that can limit the economic production of the viscous oil using SAGD is the heterogeneous nature of the reservoir. The applicability of SAGD is often limited by impermeable layers that act as barriers to vertical flow. The impermeable layers effectively compartmentalize the reservoir into thin sub-reservoirs, less than 15 meters in length at its minimum. These thin layers cannot be economically developed with gravity drainage processes because of the thickness requirement for the reservoir. In one embodiment the method utilizes hydraulic methods to fracture the impermeable layers and establish vertical communication between the isolated sub-reservoirs and allow a gravity drainage process to work.

There are several patents on the improvements to SAGD operation. U.S. Pat. No. 6,814,141 describes applying vibrational energy in a well fracture to improve SAGD operation. U.S. Pat. No. 5,899,274 teaches addition of solvents to improve oil recovery. U.S. Pat. No. 6,544,411 describes decreasing the viscosity of crude oil using ultrasonic source. U.S. Pat. No. 7,091,460 claims in situ, dielectric heating using variable radio frequency waves.

In a recent patent publication (U.S. Patent Publication 20070289736/US-A1, filed May 25, 2007), it is disclosed to extract hydrocarbons from a target formation, such as a petroleum reservoir, heavy oil, and tar sands by utilizing microwave energy to fracture the containment rock and for liquification or vitalization of the hydrocarbons.

In another recent patent publication (US Patent Publication 20070131591/US-A1, filed Dec. 14, 2006), it is disclosed that lighter hydrocarbons can be produced from heavier carbon-base materials by subjecting the heavier materials to microwave radiations in the range of about 4 GHz to about 18 GHz. This publication also discloses extracting hydrocarbons from a reservoir where a probe capable of generating microwaves is inserted into the oil wells and the microwaves are used to crack the hydrocarbons with the cracked hydrocarbon thus produced being recovered at the surface.

Despite these disclosures, it is unlikely that direct microwave cracking or heating of hydrocarbons would be practical or efficient. It is known that microwave energy is absorbed by a polar molecule with a dipole moment and bypasses the molecules that lack dipole moment. The absorption of the microwave energy by the polar molecule causes excitation of the polar molecule thereby transforming the microwave energy into heat energy (known as the coupling effect). Accordingly, when a molecule with a dipole moment is exposed to microwave energy it gets selectively heated in the presence of non-polar molecules. Generally, heavy oils comprise non-polar hydrocarbon molecules; accordingly, hydrocarbons would not get excited in the presence of microwaves.

Additionally, while the patent publication above claims to break the hydrocarbon molecules, the energy of microwave photons is very low relative to the energy required to cleave a hydrocarbon molecule. Thus, when hydrocarbons are exposed to microwave energy, it will not affect the structure of a hydrocarbon molecule. (See, for example, "Microwave Synthesis", CEM Publication, 2002 by Brittany Hayes).

BRIEF SUMMARY OF THE DISCLOSURE

A process of drilling a borehole into a heavy oil formation comprising a frac barrier between a first pay zone and a second pay zone wherein the frac barrier prevents a subterranean steam chamber region to be formed between the first pay zone and the second pay zone. The frac barrier is then heated with a microwave frequency and the frac barrier is fractured to permit the subterranean steam chamber region to be formed within the first pay zone and the second pay zone. $H_2O$ is then injected into the subterranean steam chamber region through a first wellbore of a steam assisted gravity drainage operation. Microwaves are introduced into the subterranean steam chamber region at a frequency sufficient to excite the $H_2O$ molecules and increase the temperature of at least a portion of the $H_2O$ within the region to produce heated $H_2O$. At least a portion of the heavy oil in the region is heated by contact with the heated $H_2O$ to produce heated heavy oil. Heated heavy oil is then produced through a second wellbore of the steam assisted gravity drainage operation. Heavy oil is then recovered with the steam assisted gravity drainage operation from the subterranean steam chamber region. A portion of the $H_2O$ is injected as steam and the steam contact with at least a portion of the heavy oil in the subterranean steam chamber region so as to heat the portion of the heavy oil and reduce its viscosity so that it flows generally towards the second wellbore.

In an alternate embodiment a process is taught of drilling a borehole into a heavy oil formation comprising a frac barrier between a first pay zone and a second pay zone wherein the minimum distance of at least one pay zone is less than about 15 meters and the frac barrier prevents a subterranean steam chamber to form between the first pay zone and the second pay zone. The heavy oil formation is then perforated and fracturing fluid is injected into the heavy oil formation. The frac barrier is then heated with a microwave frequency. The frac barrier is then fracted with the fracturing fluid to permit a subterranean steam chamber region to be formed within the first pay zone and the second pay zone. $H_2O$ is then injected into the subterranean steam chamber region through a first wellbore of a steam assisted gravity drainage operation. Microwaves are introduced into the subterranean steam chamber region at a frequency sufficient to excite the $H_2O$ molecules and increase the temperature of at least a portion of the $H_2O$ within the region to produce heated $H_2O$. At least a portion of the heavy oil in the region is ten heated by contacting with the heated $H_2O$ to produce heated heavy oil. Heated heavy oil is then produced through a second wellbore of the steam assisted gravity drainage operation, thereby recovering the heavy oil with the steam assisted gravity drainage operation from the subterranean steam chamber region. In this embodiment a portion of the $H_2O$ is injected as steam and the steam contact with at least a portion of the heavy oil in the subterranean steam chamber region so as to heat the portion of the heavy oil and reduce its viscosity so that it flows generally towards the second wellbore.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

In this description, the term water is used to refer to $H_2O$ in a liquid state and the term steam is used to refer to $H_2O$ in a gaseous state.

The present embodiment describes a method of producing heavy oil from a heavy oil formation with steam assisted gravity drainage. The method begins by drilling a borehole into a heavy oil formation comprising a frac barrier between a first pay zone and a second pay zone, wherein the frac barrier prevents a steam chamber to be formed between the first pay zone and the second pay zone. The frac barrier is then heated with a radio frequency. The frac barrier is then fractured to permit a subterranean steam chamber to be formed within the first pay zone and the second pay zone. Water ($H_2O$) is then injected into the subterranean steam chamber region through a first wellbore of a steam assisted gravity drainage operation. Microwaves are introduced into the subterranean steam chamber region at a frequency sufficient to excite the water molecules and increase the temperature of at least a portion of the water within a region to produce heated water. At least a portion of the heavy oil is heated in the region by contact with the heated water to produce heated heavy oil. This is subsequently followed by producing the heated heavy oil through a second wellbore of the steam assisted gravity drainage operation. Heavy oil is then recovered with the steam assisted gravity drainage operation from the subterranean steam chamber region. In this embodiment, a portion of the water is injected as steam and the steam contact with at least a portion of the heavy oil in the subterranean steam chamber region so as to heat the portion of the heavy oil and reduce its viscosity so that it flows generally towards the second wellbore.

In one embodiment the borehole can be either the first wellbore or the second wellbore.

Figure 1:
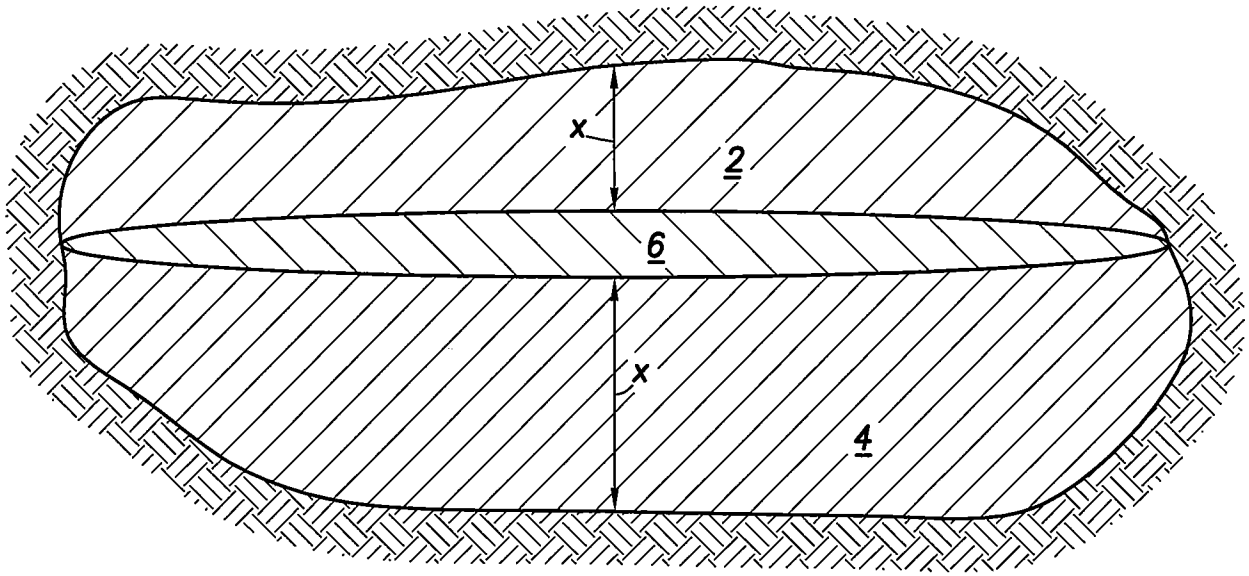
FIG. 1 depicts a heavy oil formation with a frac barrier.

As shown in FIG. 1, the first pay zone 2 and the second pay zone 4 are separated by a frac barrier 6. The frac barrier 6 prevents a subterranean steam chamber to be formed between the first pay zone and the second pay zone, thereby reducing the effectiveness of producing oil via steam assisted gravity drainage. In one embodiment the steam to oil ratio is higher than 3.5 when steam assisted gravity drainage is performed in either the first pay zone or the second pay zone prior to fracturing the frac barrier.

The present embodiment can be used in any situation where a frac barrier prevents the formation of a subterranean steam chamber between two or more pay zones to a bitumen thickness greater than 20 meters. In one embodiment the subterranean steam chamber region extends from the first pay zone into the second pay zone. In an alternate embodiment the minimum distance of at least one pay zone, indicated by x in FIG. 1 is less than about 20 meters. The cost of operating a steam assisted gravity drainage operation in a pay zone less than about 20 meters would typically cause the operation not to be cost effective. In yet another alternate embodiment the pay zone is less than about 19, 18, 17, 16, 15, 14, 13, 12, 11, 10, 9, 8, 7, 6, 5, 4, 3, 2 or 1 meter in distance.

The perforation of the well can be done by any conventional method known to one skilled in the art. Typically perforation refers to a hole punched in the casing or liner of an oil well to connect it to the reservoir. In cased hole completions, the well will be drilled down past the section of the formation desired for production and will have casing or a liner run in separating the formation from the well bore. The final stage of the completion will involve running in perforating guns, a string of shaped charges, down to the desired depth and firing them to perforate the casing or liner. A typical perforating gun can carry many dozens of charges.

After the perforation of the well a fracturing fluid can then be injected into the fracture to form a hydraulic fracture. A hydraulic fracture is typically formed by pumping the fracturing fluid into the wellbore at a rate sufficient to increase the pressure downhole to a value in excess of the fracture gradient of the formation rock. The pressure causes the formation to crack, allowing the fracturing fluid to enter and extend the crack further into the formation.

To keep this fracture open after the injection stops, a solid proppant can be added to the fracture fluid. The proppant, which is commonly a sieved round sand, is carried into the fracture. This sand is chosen to be higher in permeability than the surrounding formation, and the propped hydraulic fracture then becomes a high permeability conduit through which the formation fluids can flow to the well.

Different fracturing fluids can be used as long as they have characteristics such as:

- fluid enough to be easily pumped by the usual well completion pumps
- capable of holding a propping material while being pumped down the well but also must be capable of depositing the propping material in the cracks of the formation
- able to flow into the cracks in the formation with minimal fluid loss into the pores
- should not plug pores of the formation permanently or the capacity of the formation to produce oil will be damaged
- compatible with the hydrocarbon production from the well being fractured under the pressure and temperature conditions found in the well bore Examples of fracturing fluids that can be used include: water to gels, foams, nitrogen, carbon dioxide or air. In addition to the fracturing fluids different additives can be added to enhance the fracturing fluids such as: acid, glutaraldehyde, sodium chloride, n,n-dimethyl formaide, borate salts, polyacrylamide, petroleum distillates, guar gum, citric acid, potassium chloride, ammonium bisulfite, sodium or potassium carbonate, various proppants, ethylene glycol, and/or isopropanol.

Microwave frequency generators are operated to generate microwave frequencies capable of causing maximum excitation of the substances in the frac barrier. In some embodiments the microwave frequency will be not greater than 3000 megahertz and at a resonant frequency of water. Examples of substances present in the frac barrier include: water or salt water used in SAGD operations, asphaltene, heteroatoms and metals. For some embodiments, the microwave frequency generator defines a variable frequency source of a preselected bandwidth sweeping around a central frequency. As opposed to a fixed frequency source, the sweeping by the microwave frequency generator can provide time-averaged uniform heating of the hydrocarbons with proper adjustment of frequency sweep rate and sweep range to encompass absorption frequencies of constituents, such as water and the microwave energy absorbing substance, within the mixture. In some embodiments the microwave frequency will be not greater than 3000 megahertz and/or at a resonant frequency of water. For example, the microwave frequency generator may introduce microwaves with power peaks at a first discrete energy band around 2.45 GHz associated with water and a second discrete energy band spaced from the first discrete energy band and associated with the components with existing dipole moments in the frac barrier.

By heating the frac barrier with a radio frequency the pressure required to fracture the frac barrier is less than what is necessary the fracture the frac barrier prior to heating with the radio frequency. The pressure can be reduced with this method anywhere from 3 psi to 0.05 psi. In alternate embodiments the pressure can be reduced by 0.1, 0.25, 0.5, 0.75, 1, 1.25, 1.5, 1.75 or even 2 psi.

In one embodiment the fracturing of the frac barrier permits a steam chamber to be formed within the first pay zone and the second pay zone. By enlarging the space for the subterranean steam chamber the steam to oil ratio is lower than 3.5 when the steam assisted gravity drainage is performed in the subterranean steam chamber.

In one embodiment processes such as cyclic steam stimulation, vapor extraction, J-well steam assisted gravity drainage, in situ combustion, high pressure air injection, expanding solvent steam assisted gravity drainage or cross-steam assisted gravity drainage can be used to produce oil from the heavy oil formation.

One example of a steam assisted gravity drainage system is as follows. In the steam assisted gravity drainage process, two parallel horizontal oil wells are drilled in the formation, one about 4 to 6 meters above the other. The upper well injects steam, possibly mixed with solvents, and the lower one collects the heated crude oil or bitumen that flows out of the formation, along with any water from the condensation of injected steam. The basis of the process is that the injected steam forms a "subterranean steam chamber" that grows vertically and/or horizontally in the heavy oil formation. The heat from the steam reduces the viscosity of the heavy crude oil or bitumen which allows it to flow down into the lower wellbore. The steam and gases rise because of their low density compared to the heavy crude oil below, ensuring that steam is not produced at the lower production well. The gases released, which include methane, carbon dioxide, and usually some hydrogen sulfide, tend to rise in the subterranean steam chamber, filling the void space left by the oil and, to a certain extent, forming an insulating heat blanket above the steam. Oil and water flow is by a countercurrent, gravity driven drainage into the lower well bore. The condensed water and crude oil or bitumen is recovered to the surface by pumps such as progressive cavity pumps that work well for moving high-viscosity fluids with suspended solids.

Figure 2:
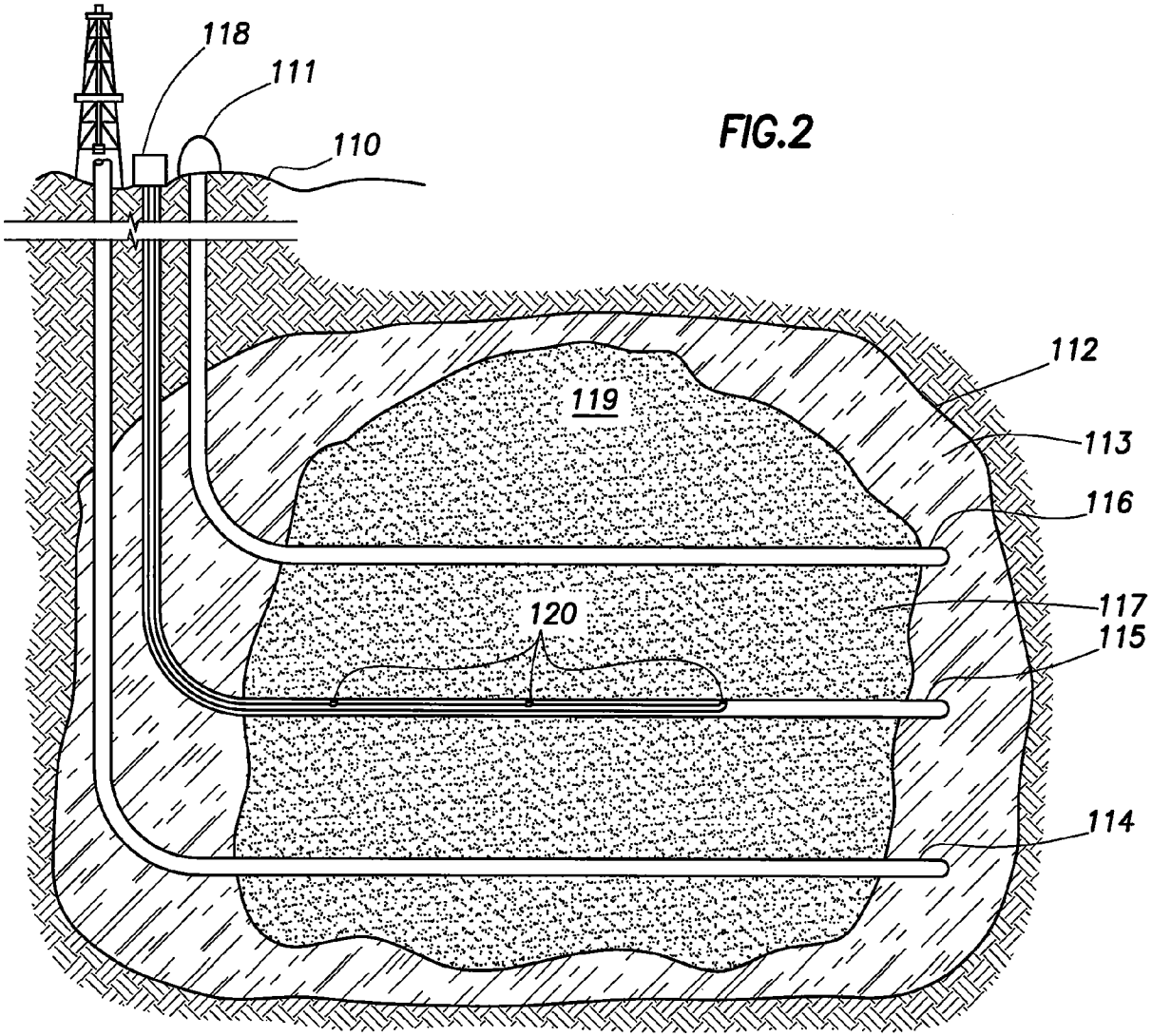
FIG. 2 is a schematic diagram illustrating a heavy oil heating process, wherein wave guides are used to introduce the microwaves to the reservoir.

The depiction of FIG. 2 describes the situation where a subterranean steam chamber has already formed. Wellbore 114 extends from the surface 110 into a lower portion of subterranean steam chamber region 112. Wellbore 116 extends from the surface 110 into subterranean steam chamber region 112 and generally will be higher than wellbore 114. Wellbore 116 will be used to inject $H_2O$ and it is preferred that it is located higher than wellbore 114 so that when the injected $H_2O$ heats the heavy oil, the heavy oil will flow generally towards wellbore 114, which is used to extract the heavy oil from the reservoir. In one embodiment a portion of the $H_2O$ is injected as steam and the steam contacts with at least a portion of the heavy oil in the region so as to heat the portion of the heavy oil and reduce its viscosity so that it flows generally towards the second wellbore. Wellbore 115 is used to introduce microwaves to the reservoir and it is preferred that wellbore 115 be located intermittent to wellbores 114 and 115; although, other arrangements are possible.

In operation, steam generated in boiler 111 is provided into the subterranean steam chamber region 112 through upper wellbore leg 116. The steam heats the heavy oil within zone 117 of the oil-bearing portion 113 of subterranean steam chamber region 112 causing it to become less viscous and, hence, increase its mobility. The heated heavy oil flows downward by gravity and is produced through wellbore leg 114. While FIG. 1 illustrates a single wellbore for injection and a single wellbore for extraction, other configurations are within the scope of the invention, for example, there can be two or more separate wellbores to provide steam injection and two or more separate wellbores for production. Similarly, multiple wellbores can be used for microwave introduction to the reservoir, as further discussed below.

Generally, the wellbore for steam injection, wellbore 116, will be substantially parallel to and situated above the wellbore for production, wellbore 114, which is located horizontally near the bottom of the formation. Pairs of steam injection wellbores and production wellbores will generally be close together and located at a suitable distance to create an effective steam chamber and yet minimizing the preheating time. Typically, the pairs of injection and production wellbores will be from about 3 meters to 7 meters apart and preferably there will be about 5 meters of vertical separation between the injector and producer wellbores. In other embodiments it is possible for the injection and production wellbores be anywhere from 1, 3, 5, 7, 12, 15, 20 even 25 meters of horizontal separation apart. Additionally, in other embodiments it is possible for the injection and production wellbores be anywhere from 1, 3, 5, 7, 12, 15, 20 even 25 meters of vertical separation apart. In this type of SAGD operation, the zone 117 is preheated by steam circulation until the reservoir temperature between the injector and producer wellbore is at a temperature sufficient to drop the viscosity of the heavy oil so that it has sufficient mobility to flow to and be extracted through wellbore 114. Generally, the heavy oil will need to be heated sufficiently to reduce its viscosity to below 3000 cP; however, lower viscosities are better for oil extraction and, thus, it is preferable that the viscosity be below 1500 cP and more preferably below 1000 cP. Preheating zone 117 involves circulating steam inside a liner using a tubing string to the toe of the wellbore. Both the injector and producer would be so equipped. Steam circulation through wellbores 114 and 116 will occur over a period of time, typically about 3 months. During the steam circulation, heat is conducted through the liner wall into the reservoir near the liner. At some point before the circulation period ends, the temperature midway between the injector and producer will reach a temperature wherein the bitumen will become movable typically around 3000 cP or less or from about 80 to 100° C. Once this occurs, the steam circulation rate for wellbore 114 will be gradually reduced while the steam rate for the injector wellbore 116 will be maintained or increased. This imposes a pressure gradient from high, for the area around wellbore 116, to low, for the area around wellbore 114. With the oil viscosity low enough to move and the imposed pressure differential between the injection and production wellbores, steam (usually condensed to hot water) starts to flow from the injector into the producer. As the steam rate is continued to be adjusted downward in wellbore 114 and upward in wellbore 116, the system arrives at steam assisted gravity drainage operation with no steam injection through wellbore 114 and all the steam injection through wellbore 116. Once hydraulic communication is established between the pair of injector and producer wellbores, steam injection in the upper well and liquid production from the lower well can proceed. Due to gravity effects, the steam vapor tends to rise and develop a steam chamber at the top section 119 of zone 117. The process is operated so that the liquid/vapor interface is maintained between the injector and producer wellbores to form a steam trap which prevents live steam from being produced through the lower wellbore.

During operation, steam will come into contact with the heavy oil in zone 117 and, thus, heat the heavy oil and increase its mobility by lessening its viscosity. Heated heavy oil will tend to flow downward by gravity and collect around wellbore 114. Heated heavy oil is produced through wellbore 114 as it collects. Steam contacting the heavy oil will lose heat and tend to condense into water. The water will also tend to flow downward toward wellbore 114. In past SAGD operations, this water would also be produced through wellbore 114. Such produced water would need to be treated to reduce impurities before being reheated in the boiler for subsequent injection. As the process continues operation, zone 117 will expand with heavy oil production occurring from a larger portion of oil-bearing portion 113 of subterranean steam chamber formation 112.

Turning again to FIG. 2, the current invention provides for microwave generator 118 to generate microwaves which are directed underground and into zone 117 of the reservoir through a series of wave guides 120. The diameter of the wave guides will preferably be more than 3 inches in order to ensure good transmission of the microwaves. Within the reservoir, the microwaves will be at a frequency substantially equivalent to the resonant frequency of the water within the reservoir so that the microwaves excite the water molecules causing them to heat up. Optimally, the microwaves will be introduced at or near the liquid vapor interface so that condensed steam is reheated from its water state back into steam further supplying the steam chamber. In some embodiments the microwave frequency will be not greater than 3000 megahertz and/or at a resonant frequency of water. Based on the resonant frequency of water, the optimum frequency will be 2450 megahertz; however, power requirements and other factors may dictate that another frequency is more economical. Additionally, salt and other impurities may enhance the coupling effect (production of heat by resonance of a polar or conductive molecule with microwave energy); thus, the presence of salt is desirable.

Figure 3:
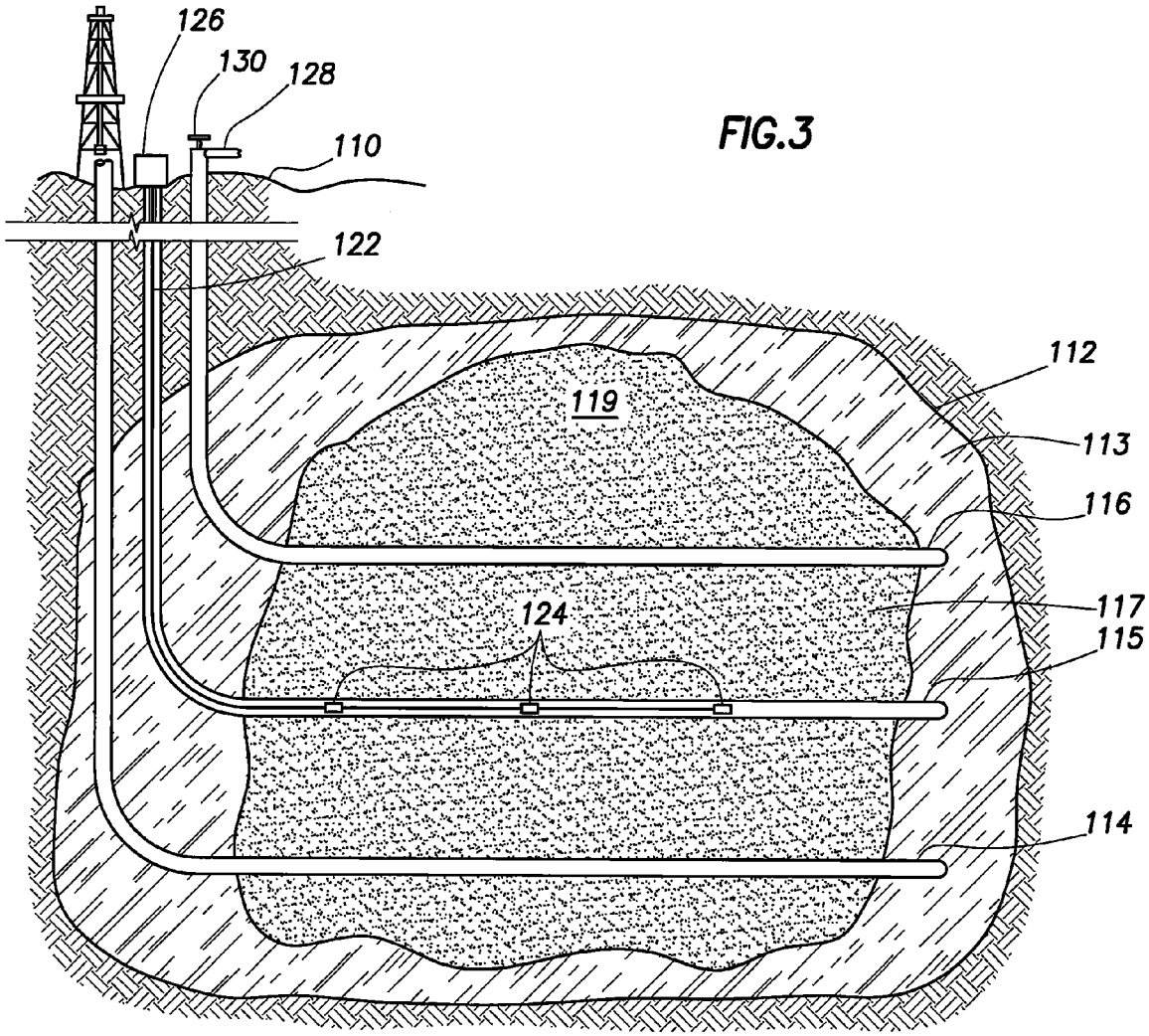
FIG. 3 is a schematic diagram illustrating a heavy oil heating process wherein the microwaves are introduced into the reservoir using a microwave generator located within the reservoir.

Turning now to FIG. 3, a further embodiment of the invention is illustrated wherein, instead of using wave guides, power is supplied through electrical wire 122 to microwave generating probe 124. The electrical power can be supplied to wire 122 by any standard means such as generator 126.

In still another embodiment of the invention, also illustrated in FIG. 3, no steam boiler is used. Instead water is introduced directly into wellbore 116 through pipe 128 and valve 130. Wellbore 116 then introduces water into the reservoir instead of steam and the entire steam production would be accomplished through use of the microwave generators. This embodiment of the invention has the added advantage of avoiding costly water treatment that is necessary when using a boiler to generate steam because, as discussed above, salt and other impurities can aid in heat generation. In a preferred embodiment, the water introduced into the reservoir would have a salt content greater than the natural salt content of the reservoir, which is typically about 5,000 to 7,000 ppm. Accordingly, it is preferred that the introduced water has a salt content greater than 10,000 ppm. For enhanced heat generation 30,000 to 50,000 ppm is more preferred.

Microwave generators useful in the invention would be ones suitable for generating microwaves in the desired frequency ranges recited above. Microwave generators and wave guide systems adaptable to the invention are sold by Cober Muegge LLC, Richardson Electronics and CPI International Inc.

Steam to oil ratio is an important factor in SAGD operations and typically the amount of water required will be 2 to 3 times the oil production. Higher steam to oil production ratios require higher water and natural gas costs. The present invention reduces water and natural gas requirements and reduces some of the water handling involving recycling, cooling, and cleaning up the water.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A process comprising:

drilling a borehole into a heavy oil formation comprising a frac barrier between a first pay zone and a second pay zone, wherein the frac barrier prevents a subterranean steam chamber region to be formed between the first pay zone and the second pay zone;

heating the frac barrier with a microwave frequency;

fracturing the frac barrier to permit the subterranean steam chamber region to be formed within the first pay zone and the second pay zone;

injecting $H_2O$ into the subterranean steam chamber region through a first wellbore of a steam assisted gravity drainage operation;

introducing microwaves into the subterranean steam chamber region at a frequency sufficient to excite the $H_2O$ molecules and increase the temperature of at least a portion of the $H_2O$ within the region to produce heated $H_2O$ heating at least a portion of the heavy oil in the region by contact with the heated $H_2O$ to produce heated heavy oil; and producing the heated heavy oil through a second wellbore of the steam assisted gravity drainage operation;

thereby recovering heavy oil with the steam assisted gravity drainage operation from the subterranean steam chamber region;

wherein a portion of the $H_2O$ is injected as steam and the steam contacts with at least a portion of the heavy oil in the subterranean steam chamber region so as to heat the portion of the heavy oil and reduce its viscosity so that it flows generally towards the second wellbore.

2. The process of claim 1, wherein the minimum distance of at least one pay zone is less than about 15 meters from top to bottom.

3. The process of claim 1, wherein the subterranean steam chamber region extends from the first pay zone into the second pay zone.

4. The process of claim 1, wherein the heavy oil formation is perforated with a perforating gun.

5. The process of claim 1, wherein the steam to oil ratio is lower than 3.5 when the steam assisted gravity drainage is performed in the subterranean steam chamber region formed within the first pay zone and the second pay zone.

6. The process of claim 1, wherein the steam to oil ratio is higher than 3.5 when steam assisted gravity drainage is performed in either the first pay zone or the second pay zone prior to fracturing the frac barrier.

7. The process of claim 1, wherein the borehole is either the first wellbore or the second wellbore.

8. The process of claim 1 wherein at least a portion of the steam condenses to a liquid state to form water as a result of its contact with the heavy oil and wherein the microwaves excite the molecules of at least a portion of the water so that the water is heated and becomes steam.

9. The process of claim 1 wherein the microwaves are generated at the surface and introduced into the subterranean steam chamber region through at least one waveguide.

10. The process of claim 1 wherein the microwaves are generated within the subterranean steam chamber region.

11. The process of claim 1 further comprising injecting at least a portion of the $H_2O$ as water and wherein the microwaves excite the molecules of at least a portion of the thus injected water so that the water is heated and becomes steam.

12. The process of claim 1 wherein the thus injected water $H_2O$ has a salt content of at least 10,000 ppm.

13. The process of claim 1 wherein the steam contacts at least a portion of the heavy oil in the subterranean steam chamber region so as to heat the heavy oil and reduce its viscosity so that it flows generally towards the second wellbore.

14. A process comprising:

drilling a borehole into a heavy oil formation comprising a frac barrier between a first pay zone and a second pay zone wherein the minimum distance of at least one pay zone is less than about 15 meters from top to bottom and the frac barrier prevents a subterranean steam chamber region to form between the first pay zone and the second pay zone;

perforating the heavy oil formation;

injecting a fracturing fluid into the heavy oil formation;

heating the frac barrier with a microwave frequency;

fracturing the frac barrier with the fracturing fluid to permit a subterranean steam chamber region to be formed within the first pay zone and the second pay zone;

injecting $H_2O$ into the subterranean steam chamber region through a first wellbore of a steam assisted gravity drainage operation;

introducing microwaves into the subterranean steam chamber region at a frequency sufficient to excite the $H_2O$ molecules and increase the temperature of at least a portion of the $H_2O$ within the region to produce heated $H_2O$ heating at least a portion of the heavy oil in the region by contact with the heated $H_2O$ to produce heated heavy oil; and producing the heated heavy oil through a second wellbore of the steam assisted gravity drainage operation;

thereby recovering heavy oil with the steam assisted gravity drainage operation from the subterranean steam chamber region;

wherein a portion of the $H_2O$ is injected as steam and the steam contacts with at least a portion of the heavy oil in the subterranean steam chamber region so as to heat the portion of the heavy oil and reduce its viscosity so that it flows generally towards the second wellbore.

15. The method of claim 14, wherein the fracturing fluid contains a proppant.

16. The method of claim 14, wherein the fracturing fluid is water.

17. The method of claim 14, wherein the fracture created with the fracturing fluid is a vertical fracture.

18. The method of claim 14, wherein the steam to oil ratio is lower than 3.5 when the steam assisted gravity drainage is performed in the steam chamber formed within the first pay zone and the second pay zone.

19. The method of claim 14, wherein the steam to oil ratio is higher than 3.5 when steam assisted gravity drainage is performed in either the first pay zone or the second pay zone prior to fracturing the frac barrier.

20. The method of claim 14, wherein the pressure used to fracture the frac barrier is less than what is necessary to fracture the frac barrier prior to heating with the radio frequency.

21. A process comprising:

drilling a borehole into a heavy oil formation comprising a frac barrier between an upper pay zone and a lower pay zone wherein the minimum distance of at least one pay zone is less than about 15 meters from top to bottom and the frac barrier prevents a thermal connection between the upper pay zone and the lower pay zone;

perforating the heavy oil formation;

injecting a fracturing fluid into the heavy oil formation, wherein the fracturing fluid contains a proppant;

heating the frac barrier with a radio frequency;

vertically fracturing the frac barrier with the fracturing fluid to permit a thermal connection within the upper pay zone and the lower pay zone, wherein the pressure used to fracture the frac barrier is less than what is necessary to fracture the frac barrier prior to heating with the radio frequency;

injecting $H_2O$ into a subterranean steam chamber region through a first wellbore of a steam assisted gravity drainage operation;

introducing microwaves into the subterranean steam chamber region at a frequency sufficient to excite the $H_2O$ molecules and increase the temperature of at least a portion of the $H_2O$ within the region to produce heated $H_2O$ heating at least a portion of the heavy oil in the region by contact with the heated $H_2O$ to produce heated heavy oil; and producing the heated heavy oil through a second wellbore of the steam assisted gravity drainage operation;

thereby recovering heavy oil with the steam assisted gravity drainage operation from the subterranean steam chamber region;

wherein a portion of the $H_2O$ is injected as steam and the steam contacts with at least a portion of the heavy oil in the subterranean steam chamber region so as to heat the portion of the heavy oil and reduce its viscosity so that it flows generally towards the second wellbore and wherein the subterranean steam chamber region extends from the lower pay zone into the upper pay zone.

* * * * *